United States Patent [19]

Karnis

[11] 4,361,464

[45] Nov. 30, 1982

[54] RAPID METHOD FOR LIBERATING THE LATENT PROPERTIES OF MECHANICAL PULPS

[75] Inventor: Alkibiadis Karnis, Dollard Des Ormeaux, Canada

[73] Assignee: Domtar Inc., Montreal, Canada

[21] Appl. No.: 82,302

[22] Filed: Oct. 5, 1979

Related U.S. Application Data

[63] Continuation-in-part of Ser. No. 733,297, Oct. 18, 1976, abandoned.

[51] Int. Cl.[3] ..... D21B 1/00

[52] U.S. Cl. ..... 162/49; 162/59

[58] Field of Search ..... 162/1, 49, 100, 150, 162/261, 59; 137/563

[56] References Cited

PUBLICATIONS

Beath et al. *Pulp & Paper Magazine of Canada* Oct. 1966, p. T-432 thru T-430.

Brochure of D. J. Murray Manufacturing Co., 1948, "Murray Pulp Stock Agitator".

*Primary Examiner*—William F. Smith

[57] ABSTRACT

A method and apparatus for liberating the latent properties of a mechanical pulp is disclosed. The method is a laboratory technique for sample preparation for further pulp testing. "Latency" is released by recirculating pulp from a pool thereof through a centrifugal pump at a rate of at least four times per minute for the period required to release all the latent properties of the pulp sample ("Latency"). This depending on the rate of circulation may be completed in as little as one minute.

2 Claims, 3 Drawing Figures

RAPID METHOD FOR LIBERATING THE LATENT PROPERTIES OF MECHANICAL PULPS

This application is a continuation in part of application Ser. No. 733,297 filed Oct. 18, 1976 now abandoned.

FIELD OF THE INVENTION

The present invention relates to method for releasing latent properties of ("latency") of mechanical pulps. More particularly the present invention relates to a technique for rapidly releasing the latent properties of a mechanical pulp.

PRIOR ART

In the early stages of manufacturing mechanical pulps from chips it was observed that to develop the inherent strength of the produced pulp a treatment by mild agitation, at low consistency and elevated temperature was required. It has been postulated that fiber nodules formed during the refining (or grinding) process are frozen in distorted shape (twisted, kinked and curled) when diluted with cold water and that these nodules which are composed of cellulose, hemi-cellulose and lignin must be elastically straightened by heating the pulp at the temperature above 60° C. where the lignin begins to soften to develop substantially fully the properties of the pulp.

This phenomena of "latency" in mechanical pulps has been further investigated and laboratory methods for testing mechanical pulps by first liberating the ("Latency") properties of the pulp have been proposed, however, neither CPPA nor TAPPI have suggested a standard laboratory procedure for "latency" release. An accepted "standard" method is to dilute the stock with boiling water at a consistency of 1.5% and maintain the stock at an elevated temperature for 15 minutes followed by disintegrating the sample in a British disintegrator. Because of the relatively long time required in this "standard" method the temperature of the stock drops and inconsistent results have been observed especially when treating thermo-mechanical pulp samples of relatively low freeness.

Much work is and has been done on automatic control of refined mechanical pulp production, however, if such a control is to be effective it must respond reasonably rapidly to changing conditions in the mill. Such controls are predicated on measuring pulp perameters and thus measuring of such perameters quickly is of major significance. As above indicated before any measurement of properties may be made it is necessary to liberate the latent properties of the pulp, but any known techniques require an absolute minimum of ten minutes.

The recognized or "standard" technique for liberating the latent pulp properties used in North America as described by Skeet and Allan paper in the Pulp and Paper Magazine of Canada, April 19, 1968 p. 71-T223aT224. In this technique the pulp at 90° C.±3° C. and a consistency of 1.25% O.D. is agitated in a British Disintegrator for 15 minutes (45,000 revs).

In Scandinavia the recognized test is SCAN-M 10:76. In this test hot pulp (85° C.) is disintegrated by mechanical treatment for a minimum of 10 minutes.

In a paper by Beath et al published in the "Pulp and Paper Magazine of Canada" October 1966 P. T-423 to T-430 a technique for liberating the latency of a mechanical pulp is disclosed wherein about 80% of the properties are available within one minute but wherein significantly longer times are required to liberate all of those properties. To provide a pulp ready for testing requires at least 15 minutes according to Beath et al.

BRIEF DESCRIPTION OF THE INVENTION

The present invention permits the release of latent properties of mechanical pulps in much less time than previously thought possible and provides a technique that will facilitate development of on line control systems.

Broadly the present invention relates to the method for the release of latent properties of a mechanical pulp comprising forming a pool of a sample of said pulp at pumpable consistency and at a temperature of at least 80° C. in a container, withdrawing pulp from said container to a centrifical pump, pumping said sample through said centrifical pump and returning it to said container at least four times a minute for a period of at least two minutes to liberate all the latent properties of the pulp.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
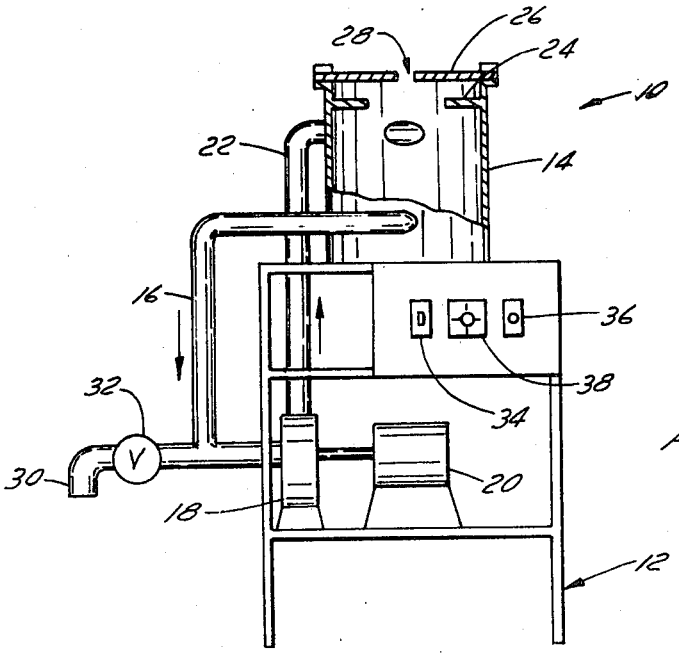
FIG. 1 is a schematic illustration partly in section of a laboratory device for carrying out the present invention.

The apparatus 10 as illustrated in FIG. 1 is mounted on a stand 12 and consists of a cylindrical sample container 14 connected via piping 16 to the inlet of a pump 18 and via line 22 from the outlet of 18 back to the top of the container 14. The outlet 16 and inlet lines 22 are arranged to withdraw and to reinject the sample tangentially from and to the cylindrical container 14.

The container 14 preferably is provided with a baffle 24 and a removable lid 26 the latter being provided with a steam release aperture 28.

The sample may be withdrawn from the device through the pipe 30 controlled by valve 32.

Preferably the device will be provided with an on-off switch 34, a jogging switch 36 and an automatic timer mechanism 38 to control the operation of the motor 20.

All the test results reported herein were generated utilizing the above described apparatus with different capacity containers in order to obtain the different recirculation rates.

TABLE I

| RUN | IMPELLER SPEED REV/MIN | AGITATOR MOTOR LOAD KW | AGITATOR SPEED REV/MIN | STOCK °C. INITIAL | TEMP FINAL | RECIRCULATION RATE $MIN^{-1}$ | TIME REG'D TO REMOVE LATENCY | STOCK CONSIS. % o.d. |
|---|---|---|---|---|---|---|---|---|
| 1 | 3,480 | — | — | 86 | 85 | 1 | over 15 | 1.9 |
| 2 | " | — | — | 86 | 79 | 2 | 10 | 2.1 |
| 3 | " | — | — | 85 | 71 | 4 | 3 | 1.9 |
| 4 | 3,450 | — | — | 86 | 86 | 35 | 2 | 2.0 |
| 5 | " | — | — | 86 | 86 | 86 | 2 | 2.0 |
| 6 | 3,480 | 0.373 | 1,550 | 86 | 83 | 1 | 15 | 2.0 |
| 7 | "Standard" Method | 0.186 | 3,000 | 85 | 80 | — | 15 | 1.5 |

In accordance with the method of the present invention a pulp sample is introduced into the container 14 at a temperature of between about 80° C. to 95° C. and pump 18 is activated to circulate the stock through the pipe 16 pump 18 and back to the tank 14 via line 22. In Table 1 various circulation rates are compared with the standard method of releasing the latent properties and these results have also been plotted in FIG. 2.

The time to liberate latent properties is based on the Canadian standard freeness since it is well established that the freeness is an excellent indication of whether the latent properties of the pulp have been released, i.e. the latent properties of the pulp are available, thus throughout the disclosure the freeness has been taken as an indication of release of the latent properties.

Figure 2:
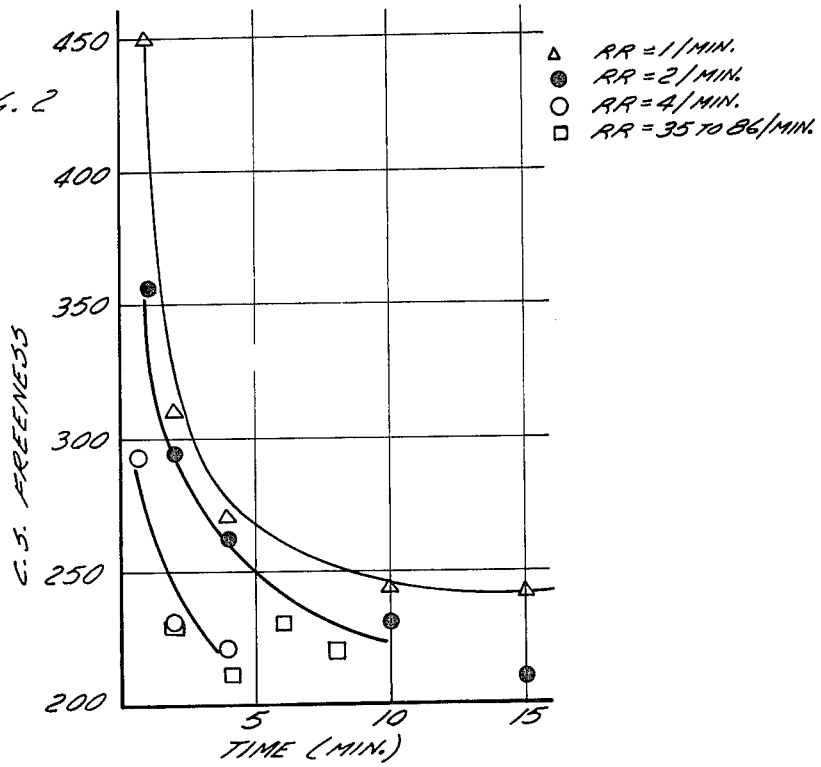
FIG. 2 is a plot of the time required to reach a constant freeness for different rates of recirculation.
Figure 3:
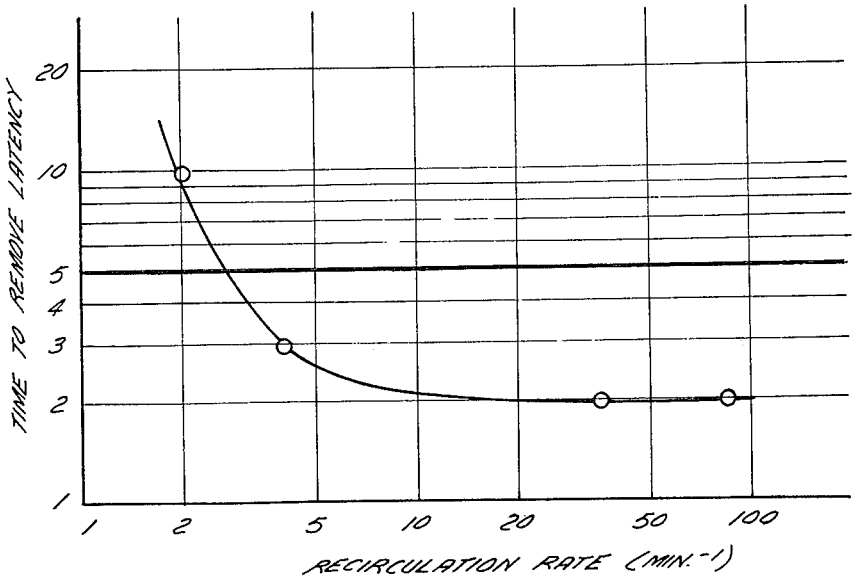
FIG. 3 is a plot of time to release "latency" versus recirculation rate.

Referring to FIGS. 2 and 3 and Table 1 it will be apparent that at very low recirculation rates (wherein the total stock in the container 14 is recirculated only once) the total time to liberate the latent properties was to be equal to the time required by the standard method. Similarly from run 6 it will be noted even when an agitator as conventionally used was inserted and the stock is recirculated only once through the pump the time required to release the latent properties remained the same as for the standard method (15 minutes). When the pump rate was doubled to twice per minute the time required decreased significantly to 10 minutes and when this rate was doubled to 4 the latency was removed in three minutes. However, in the laboratory apparatus, it is preferred to operate at recirculation rates per minute of over five and to be in the regime indicated by the runs no. 4 and 5 where the recirculation rate was 35 and 86 respectively so that the latency may be completely released within a period of two minutes (there is little point increasing the time period since when the properties are released the extra time does nothing). Preferably the rate will be more than ten cycles per minute for a time of two minutes or less. Generally the recirculation rate should be at least 5 cycles per minute and latent properties will be released in three minutes.

It is noted that in the standard method where agitation was used the time required to release the latent properties was 15 minutes whereas with the instant invention where recirculation of the material through a centrifical pump is used this time is drastically reduced. It is not completely evident why recirculation through the pump so significantly effects the time required. It may be that the shear forces applied to the hot pulp suspension in the pump and as it is drawn and/or discharged through the piping of the system tends to pull the fibers or entrain the fibers and thus straighten them and reduce their kinked or curled formation.

The stock must be of pumpable consistency and preferably will be at a consistency of between 2 to 3%. The time to release the latent properties increases as the consistency is increased.

It is important that the temperature be maintained relatively high, preferably above 80° C. and between 80° and 95° C. so that the components of the stock are sufficiently soft and pliable that the latency may easily be removed. If the stock is too cool latency is very difficult to remove.

Table 2 provides a comparison of pulp and handsheed properties using the "standard" method of latency removal and the method of the present invention, i.e. a recirculation rate of 35 times per minute for a time of two minutes.

TABLE II

COMPARISON OF PULP AND HANDSHEET PROPERTIES

| Property | Standard Method | Domtar Method | Standard Method | Domtar Method |
|---|---|---|---|---|
| Percent Debris* (%) | 5.0 | 5.1 | 3.10 | 3.60 |
| Fibre Fractionation | | | | |
| R-14 | 11.6 | 14.4 | 21.7 | 24.6 |
| P-14/R-28 | 19.6 | 19.4 | 21.4 | 21.7 |
| P-28/R-48 | 19.6 | 19.5 | 17.6 | 18.3 |
| P-48/R-100 | 12.9 | 13.6 | 9.4 | 9.9 |
| P-100/R-200 | 7.8 | 7.6 | 5.1 | 5.1 |
| L-Factor | 50.8 | 53.3 | 60.7 | 64.6 |
| CS Freeness | — | 163 | 289 | 265 |
| Handsheet Bulk (cc/g) | 3.18 | 2.93 | 3.20 | 3.34 |
| Burst Factor KPA/(g/mg$^2$) | 1.6 | 1.7 | 1.8 | 1.6 |
| Tear Factor MN/(g/m$^2$) | 7.0 | 7.0 | 9.0 | 8.6 |
| Tensile B.L.-km | 3.37 | 3.53 | 3.76 | 3.41 |
| Elongation (%) | 1.51 | 1.64 | 1.74 | 1.67 |

*Retained in a PFI mini-shive Analyzer equipped with a 0.08 mm slit.

It will be apparent from Table 2 that the results of the standard method of removal of latency and the method of the present invention are very comparable.

Modifications may be made without departing from the spirit of the invention as defined in the appended claims.

I claim:

1. A method for releasing latent properties of mechanical pulp comprising providing a sample of mechanical pulp at a pumpable consistency and a temperature of 80° C., to 95° C. in a container, recirculating all of said sample from and to said container by means of a centrifugal pump, said pump recirculating all of said sample at a rate of at least five times a minute for a period no longer than three minutes so as to release all the latent properties of said mechanical pulp.

2. A method as defined in claim 1 wherein said sample is recirculated at a rate of over ten times a minute for a period no greater than two minutes.

* * * * *